United States Patent [19]

Fujiwara et al.

[11] Patent Number: 4,973,803

[45] Date of Patent: Nov. 27, 1990

[54] VACUUM CIRCUIT BREAKER

[75] Inventors: Junji Fujiwara, Oome; Kanya Doi, Fuchu, both of Japan

[73] Assignee: Kabushiki Kaisha Toshiba, Kawasaki, Japan

[21] Appl. No.: 352,195

[22] Filed: May 16, 1989

[30] Foreign Application Priority Data

May 16, 1988 [JP] Japan ..... 63-116954

[51] Int. Cl.[5] ..... H01H 33/66

[52] U.S. Cl. ..... 200/144 B

[58] Field of Search ..... 200/144 B, 148 R

[56] References Cited

U.S. PATENT DOCUMENTS

| | | | |
|---|---|---|---|
| 3,163,735 | 12/1964 | Miller | 200/144 B |
| 3,562,457 | 2/1971 | Peek | 200/144 B |
| 3,597,556 | 8/1971 | Sharp | 200/144 B |
| 3,691,332 | 9/1972 | Sharp | 200/144 B |
| 4,550,234 | 10/1985 | Steineuer | 200/144 B |

*Primary Examiner*—Robert S. Macon

*Attorney, Agent, or Firm*—Foley & Lardner, Schwartz, Jeffery, Schwaab, Mack, Blumenthal & Evans

[57] ABSTRACT

A vacuum circuit breaker includes a main frame and a vacuum bulb unit supported on the rear side of the main frame. The vacuum bulb unit includes an intermediate support unit disposed at a rear side of the main frame, and a pair of vertically aligned vacuum bulbs supported on the upper and lower sides of the intermediate support unit. Each of the vacuum bulbs have therein a stationary contact and a movable contact which is movably supported by the intermediate support unit. An insulator bracket has one end secured to the rear of the main frame and extends rearward to support the intermediate support unit at the other end. The insulator bracket has a substantially inverted U-shaped cross section. A pair of frame-shaped insulation mounting members are secured to the upper and lower sides of the intermediate support unit. The opening and closing operation of the contacts in the vacuum bulbs are performed by the operation of an operating rod which passes through the inner space of the insulator bracket so as to extend therealong. A link mechanism is supported in the intermediate support unit so as to be operated by the shifting of the insulating operating rod. The link mechanism opens and closes the contacts when operated.

5 Claims, 2 Drawing Sheets

VACUUM CIRCUIT BREAKER

BACKGROUND OF THE INVENTION

This invention relates to a vacuum circuit breaker particularly of the type having two breaking points.

In usual vacuum circuit breakers, open-close contacts, i.e., stationary and movable electric contacts, are provided in a vacuum chamber to easily extinguish an arc. The circuit breakers of this type include a double-breaking-point type circuit breaker in which two vacuum bulbs are connected in series for each phase.

In a typical example of the circuit breaker described above, three insulator brackets of a rod shape are secured one above the other to a rear part of a main frame of the breaker so as to extend substantially horizontally. The rear ends of the upper and lower insulator brackets support stationary electrode units, which are connected to a power source and a load, respectively. Vacuum bulbs are vertically arranged between the stationary electrode units with an intermediate supporting unit interposed therebetween. The outer side (stationary electrode side) portions of the vacuum bulbs are connected to the stationary electrode units and the inner side (movable electrode side) portions of the vacuum bulbs are supported on upper and lower sides of the intermediate supporting unit.

The rear end of the intermediate insulator bracket fixedly supports the intermediate supporting unit. The intermediate supporting unit has therein an operating mechanism connected to an operating mechanism in the main frame through an insulating operating rod which is horizontally arranged so as to operate the vacuum bulb operating unit accommodated in the intermediate supporting member. The upper and lower stationary electrode units are mechanically connected to the intermediate supporting unit through insulating plates.

With the vacuum circuit breaker of the type described, the end surfaces of the rear portions of the respective insulator brackets do not lie in the same vertical plane. This means that it involves much time to assemble together the stationary electrode units, the vacuum bulbs and the intermediate supporting unit in a mechanically well balanced condition. Furthermore, when the operating rod is operated to open or close the contacts in the vacuum bulbs, the intermediate supporting unit is caused to deform by a bending moment applied thereto, and hence, in case the vacuum circuit breaker is frequently operated, the intermediate insulator bracket may be broken in the worst case.

SUMMARY OF THE INVENTION

An object of this invention is to substantially eliminate the problems encountered in the conventional circuit breaker described above and to provide an improved vacuum circuit breaker capable of being easily assembled or disassembled and having a compact structure and long life.

This and other objects can be achieved according to this invention by providing a vacuum circuit breaker comprising a main frame having front and rear surfaces, an electrically conducting intermediate support means, a pair of vertically aligned vacuum bulbs each having therein a stationary contact and a movable contact, said support means having upper and lower portions each supporting said movable contact in a manner movable toward and away from the stationary contact, insulator bracket means supporting the intermediate support means and the vacuum bulbs on the rear surface of the main frame, and an insulating rod connecting an operation mechanism mounted to the main frame to a link mechanism in said intermediate support means for opening and closing said contacts: wherein said insulator bracket means is a single bracket extending rearward from the main frame and having a hollow internal space and said operating rod passes through the internal space and that a pair of insulation mounting members are fixedly secured to the upper and lower portions of the intermediate support means to secure the vacuum bulbs thereto.

In a preferred embodiment, the insulator bracket has an inverted U-shaped (downwardly opened) cross section to define a space therein through which the operating rod is disposed so as to extend therealong.

According to the vacuum circuit breaker of the construction described above, the vacuum bulbs are connected to the intermediate support means and secured to the insulating mounting members on both end portions of the vacuum bulbs, respectively. The opening and closing operation of the contacts in the vacuum bulbs are performed by the link mechanism which is connected to one end of the operating rod. Only one insulator bracket is located between the main frame and the vacuum bulb unit. Accordingly, the accuracy of assembly of the vacuum bulbs and the operating mechanism therefor is determined only by the accuracy of assembly of the intermediate support means and the insulation mounting members. The operation of the link mechanism is made by the operating rod which is connected at only one portion to the link mechanism, so that only tensile and compressive forces are imparted to the insulator bracket which is connected to the intermediate support unit, and any bending force is not applied thereto. In a preferred embodiment, the insulator bracket has a substantially inverted U-shaped (downwardly opened) cross section and the insulating operating rod is disposed in the inner space of the insulator bracket, so that the operating rod is protected and the accumulation of dust and the like on the operating rod is prevented.

A preferred embodiment of this invention will be described further in detail hereunder with reference to the accompanying drawings.

DESCRIPTION OF THE PREFERRED EMBODIMENT

Prior to the description of a preferred embodiment of this invention, a conventional vacuum circuit breaker will first be described hereunder with reference to FIG. 4 for a better understanding of the features of this invention.

Figure 4:
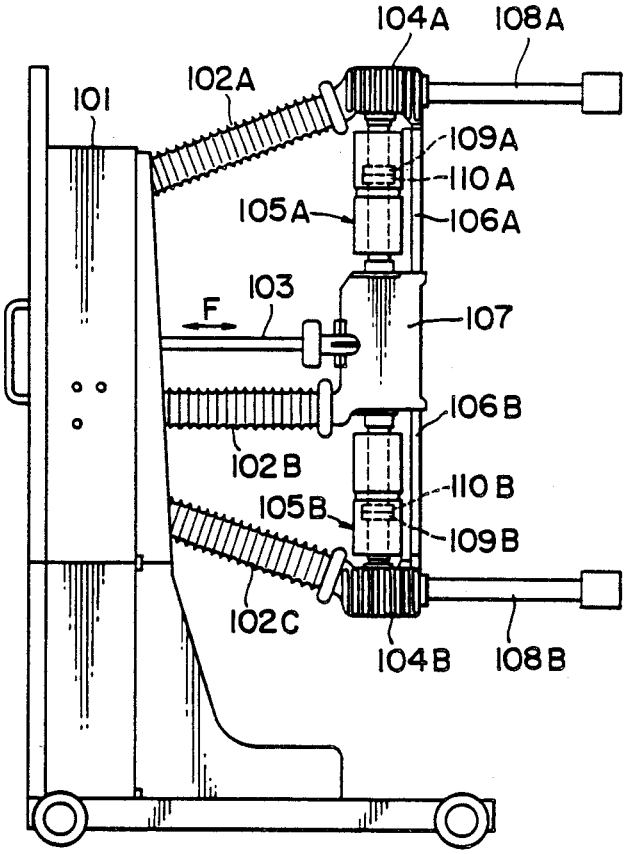
FIG. 4 PRIOR ART
FIG. 4 is a view similar to that shown in FIG. 1 but representing one example of a conventional vacuum circuit breaker.

Referring to FIG. 4, insulator bracket 102A, 102B, and 102C are disposed one above the other and are fixedly secured at their proximal ends to a rear (right-hand, as viewed) surface of a main frame 101 to extend substantially horizontally and rearwardly. The distal or rear ends of the upper and lower insulators 102A and 102C support stationary electrode units 104A and 104B, respectively, which are connected at their righthand portions (as viewed) to main circuit breaking elements 108A and 108B, respectively. Vacuum bulbs 105A and 105B are arranged vertically between the stationary electrode units 104A and 104B with an intermediate support unit 107 interposed between the bulbs. The stationary electrode units 104A and 104B have their stationary contacts 109A and 109B disposed in the bulbs 105A and 105B, respectively. Movable contacts 110A and 110B cooperating with the stationary contacts 109A and 109B are also disposed in the bulbs 105A and 105B and supported by the support unit 107, which is supported by the distal end of the insulator bracket 102B.

The intermediate support unit 107 encloses therein a movable contact operating mechanism which is operatively connected to an operating mechanism within the main frame 101 through an insulating operating rod 103 horizontally arranged between the frame 101 and the support unit 107. The upper and lower stationary electrode units 104A and 104B are mechanically connected to the intermediate support unit 107 through insulating plates 106A and 106B, respectively.

In the vacuum circuit breaker of the double breaking point type described, the end mounting surfaces of the rearmost distal portions of the respective insulator brackets 102A, 102B and 102C do not lie in exactly the same vertical plane. This fact means that it involves much time to assemble together the stationary electrode units 104A, 104B; the vacuum bulbs 105A, 105B; and the intermediate support unit 107. In addition, when the operating rod 103 is pulled or pushed to open or close the contacts 109A, 110A; 109B, 110B of the vacuum bulbs 105A and 105B, the intermediate support unit 107 is caused to deform by a bending moment applied thereto due to the pulling and pushing force F, and hence, in case the vacuum circuit breaker is frequently operated, the intermediate insulator bracket 102B may be broken in the worst case.

Figure 1:
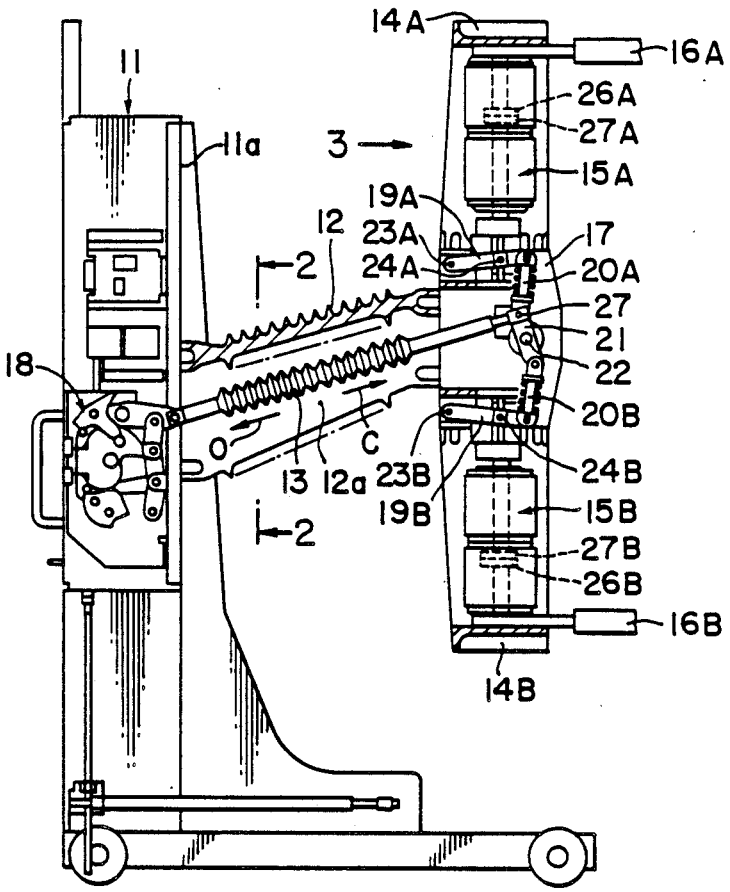
FIG. 1 is a side view, partly in vertical section, showing one embodiment of a vacuum circuit breaker according this invention.
Figure 2:
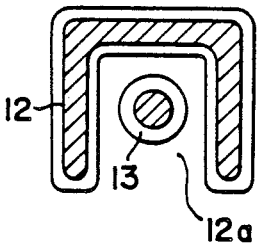
FIG. 2 is a cross sectional view taken along the line 2—2 shown in FIG. 1.
Figure 3:
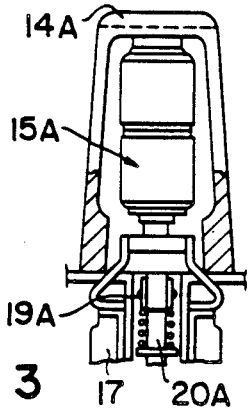
FIG. 3 is a fragmentary view as seen in the direction of arrow 3 in FIG. 1.

This invention was conceived in consideration of the problems encountered in the conventional circuit breaker described above and will be disclosed hereunder with reference to FIGS. 1, 2 and 3.

Referring to FIG. 1, a main frame 11, having front and rear surfaces, has in an intermediate portion thereof a known operating mechanism 18 for the circuit breaker. A single insulator bracket 12 having substantially an inverted U-shaped (downwardly opened cross section, as shown in FIG. 2, is fixedly secured at one end in cantileaver fashion to the rear (righthand as viewed) surface 11*a* of the intermediate portion of the main frame 11 so as to extend rearwardly therefrom to terminate at the other end. It is preferable that the insulator bracket 12 extend obliquely upward as it extends rearwardly. The rear or distal end of the insulator bracket 12 fixedly supports an electrically conducting intermediate support unit 17 for a pair of vacuum bulbs 15A and 15B having therein stationary and movable contacts 26A and 27A; 26B and 27B, respectively. The stationary contacts 26A and 26B are fixedly connected to insulation mounting members 14A and 14B, while the movable contacts 27A and 27B are supported by the support unit 17 in vertically slidable manner. Electrically conducting member 16A and 16B are connected to the station 26A and 26B, respectively.

Each of the insulation mounting members 14A and 14B is in the form of a frame as shown in FIG. 3 (showing only the upper mounting member 14A), and the vacuum bulbs 15A and 15B are disposed within the mounting members 14A and 14B in fixed relation thereto, respectively. The lower and upper ends of the mounting members 14A and 14B are rigidly secured to the upper and lower surfaces of the intermediate support unit 17, respectively.

An insulating operating rod 13 passes through an inner space 12*a* of the inverted U-shaped insulator bracket 12 so as to extend substantially horizontally. The operating rod 13 has a lefthand (as viewed) end connected to the operating mechanism 18 installed in the main frame 11 and a righthand (as viewed) end coupled by a pin 27 to one end of a main lever 21, which is disposed in the intermediate support unit 17 and is pivotably supported by a pin 22 secured to the support unit 17. One end of a spring-biased link 20A for applying pressure to the movable contact 27A in the vacuum bulb 15A is pivotally connected to the one end of the main lever 21, and one end of another spring-biased link 20B for also applying pressure to the movable contact 27B in the vacuum valve 15B is connected to the other end of the main lever 21. The other ends of these spring-biased links 20A and 20B are connected to righthand (as viewed) ends of links 19A and 19B which are pivotally supported on the support unit 17 by pins 23A and 23B secured to the unit 17, respectively. Intermediate portions of the respective links 19A and 19B are operatively coupled, through pins 24A and 24B, to the movable contacts 27A and 27B in the respective vacuum bulbs 15A and 15B. The main lever 21, links 19A and 19B, and spring biased links 20A and 2B from a link mechanism which moves the movable contacts 27A and 27B toward and away from stationary contacts 26A and 26B.

In the vacuum circuit breaker of the structure described above, when the vacuum bulbs 15A and 15B are to be changed from a "closed" state to a "opened" state, the operating mechanism 18 is operated in the manner known in the art so as to shift the operating rod 13 in a direction indicated by arrow O. In response to this operation, the main lever 21 connected to the operating rod 13 is turned in a counterclockwise direction, and accordingly, the spring-biased link 20A and 20B are pulled to turn in clockwise and counterclockwise directions, respectively, whereby the links 19A and 19B are turned to retract the movable contacts 27A and 27B in the vacuum bulbs 15A and 15B in the respectively corresponding directions through operation rods.

On the contrary, when the vacuum bulbs 15A and 15B are to be changed to the "closed" state from the "opened" state, the operating rod 13 is shifted in a direction indicated by arrow C by the operation of the mechanism 18. During this operation, the spring-biased links 20A and 20B and the links 19A and 19B carry out operating motions in directions reverse to those described above to advance the movable contacts 27A and 27B in the respective vacuum bulbs 15A and 15B. During these operations, the reaction forces caused by the shifting of the operating rod 13 in the directions of arrows O and C act in the insulator bracket 12 as a compressive force and a tensile force, respectively.

The forces applied by the springs of the spring-biased links 20A and 20B to the mounting members 14A and 14B through the operation rods in the vacuum bulbs 15A and 15B act as a vertical tensile force and a vertical compressive force. In the closed state, electric current flows from the conducting member 16A through the closed contacts 26A and 27A, the support unit 17 and the closed contacts 27B and 26B to the conducting member 16B. According to the structure of the vacuum circuit breaker of this invention, it is not necessary to consider any bending moment except the static bending moment to be imparted to the insulator bracket 12 by static loads of the mounting members 14A and 14B, the vacuum bulbs 15A and 15B and the intermediate support unit 17.

In assembling the circuit breaker of this invention, the assembling precision can be determined by the condition of the attaching surfaces between the mounting members 14A and 14B and the intermediate support unit 17, and moreover, with respect to the insulator bracket 12 of which precision manufacture is rather difficult, a significant problem on the precision of attachment or mounting is not caused since only one insulator bracket 12 is attached at only one portion.

In addition, the operating rod 13 is disposed in the inverted U-shaped (opened downwardly) insulator bracket 12, so that dust or the like hardly accumulates on the upper surface of the operating rod 13, whereby the rod 13 can be made compact with mechanically prolonged life.

The inverted U-shaped insulator bracket 12 has an increased rigidity and strength and can be easily manufactured by, for example, a molding process. Moreover, the location of the operating rod 13 in the inner space of the insulator bracket 12 at a slightly deep portion in the space makes uniform the stresses against the tensile and compressive forces applied to the opening portion and the bottom wall portion of the insulator bracket 12.

In the foregoing, the vacuum circuit breaker is described with respect to one phase only. It will be understood that other two identical contructions are used for the other two phases in the case of a three phase type.

What is claimed is:

1. A vacuum circuit breaker comprising:

a main frame having front and rear surfaces:

an insulator bracket means having one end secured to the rear surface of said main frame in a cantilever fashion so as to extend rearwardly to terminate at the other end, said insulator bracket means having a hollow internal space;

an electrically conducting intermediate support means fixedly supported on another end of said insulator bracket means;

a pair of vertically aligned vacuum bulbs each having therein a stationary contact and a movable contact, said support means having upper and lower portions each supporting a respective end of said movable contact contacts in a manner movable toward and away from the respective stationary contact;

a pair of insulation mounting members fixedly secured to the upper and lower portions of said intermediate support means to secure the vacuum bulbs thereto;

an operation mechanism mounted to said main frame;

a link mechanism installed in said intermediate support means and connected to the movable contact in each of said vacuum bulbs so as to move each movable contact toward and away from the respective stationary contact; and an insulating operating rod passing through the hollow internal space of said insulator bracket means and having one end coupled to said operation mechanism and the other end coupled to said link mechanism, whereby the operation of said operation mechanism causes said link mechanism to open and close said contact.

2. The vacuum circuit breaker according to claim 1 wherein said insulator bracket means has an inverted U-shaped cross section.

3. The vacuum circuit breaker according to claim 1 wherein said link mechanism comprises a main lever pivoted intermediately on said support means, spring-biased links connected at one ends thereof to respective ends of said main lever and operatively connected at the other ends thereof to the respective movable contacts in vacuum bulbs, said main lever being also connected to said other end of said insulating operating rod.

4. The vacuum circuit breaker according to claim 1 wherein said insulation mounting members have a form of a frame and said vacuum bulbs are secured in said mounting members.

5. The vacuum circuit breaker according to claim 1 wherein said insulator bracket means extends obliquely upward as it extends rearwardly.

* * * * *